US009915501B2

(12) United States Patent
Grey

(10) Patent No.: US 9,915,501 B2
(45) Date of Patent: Mar. 13, 2018

(54) WEAPON SIGHT AND WEAPON FORMED THEREWITH

(71) Applicant: Tyler A. Grey, Las Vegas, NV (US)

(72) Inventor: Tyler A. Grey, Las Vegas, NV (US)

( * ) Notice: Subject to any disclaimer, the term of this patent is extended or adjusted under 35 U.S.C. 154(b) by 0 days.

(21) Appl. No.: 14/988,003

(22) Filed: Jan. 5, 2016

(65) Prior Publication Data

US 2016/0258715 A1 Sep. 8, 2016

Related U.S. Application Data

(60) Provisional application No. 62/129,788, filed on Mar. 7, 2015.

(51) Int. Cl.
*F41G 1/01* (2006.01)
*F41G 1/02* (2006.01)
*F41G 1/10* (2006.01)

(52) U.S. Cl.
CPC ..... *F41G 1/01* (2013.01); *F41G 1/02* (2013.01); *F41G 1/10* (2013.01)

(58) Field of Classification Search
USPC ..... 42/111
See application file for complete search history.

(56) References Cited

U.S. PATENT DOCUMENTS 821,821 A * 5/1906 Nickerson ..... F41G 1/473 42/142
3,698,091 A * 10/1972 Merrill ..... F41G 1/01 42/144
4,993,158 A * 2/1991 Santiago ..... F41G 1/425 42/135
8,261,481 B1 * 9/2012 Shebaro ..... F41G 1/12 42/113

* cited by examiner

*Primary Examiner* — J. Woodrow Eldred
(74) *Attorney, Agent, or Firm* — Workman Nydegger

(57) ABSTRACT

A weapon includes a firearm having a front sight and a rear sight. The front sight includes a front channel. The rear sight includes a rear channel. The front channel and the rear channel are aligned along a sight line. The front channel and the rear channel provide an unobstructed field of view toward a target along the sight line.

13 Claims, 4 Drawing Sheets

WEAPON SIGHT AND WEAPON FORMED THEREWITH

CROSS-REFERENCE TO RELATED APPLICATION

This application claims the benefit of U.S. Provisional Patent Application No. 62/129,788, filed Mar. 7, 2015, the entire contents of which are incorporated herein by reference.

FIELD OF THE INVENTION

The present invention relates to weapons and, more particularly, to weapon sights.

BACKGROUND OF THE INVENTION

A firearm is a weapon from which a shot is discharged by gunpowder. Firearms typically include sight device for guiding the eye of a shooter along a sight line or axis for aiming the firearm toward a selected target. Of particular significance are two-piece sights composed of two separate components including front and rear aiming pieces or sights lined up along a sight line or axis. In such a two-piece sight, the firearm is aimed toward a selected target by aligning the front sight with the rear sight. In a conventional two-piece sight, the front sight includes a post or bead, which is aligned within a notch or aperture of the rear sight. Centering the front sight within the rear sight along the sight line or axis by eye enables the shooter to accurately target a selected target downrange along the sight line or axis.

The front and rear sights of a two-piece site are located on either end of the firearm barrel, and are aligned substantially parallel to the central longitudinal axis of the firearm barrel, whereby a bullet fired from the firearm will strike the selected target below the point of aim. A bullet fired from a firearm inherently drops during flight, producing a curved trajectory. Accordingly, two-piece sights are often aligned at a slight angle to the central longitudinal axis of the barrel, whereby the sight line of the aligned front and rear sights results in a slight upward angle of the central longitudinal axis of the barrel enabling a bullet fired from the firearm to pass through the sight line first when the bullet rises and then as it is falling. The term "substantially parallel" in relation to the alignment of the front and rear sights of a two-piece sight relative to the central longitudinal axis of the firearm barrel is a term of art that characterizes two-piece sights that are aligned at a pre-selected slight angle relative to the central longitudinal axis of the firearm barrel. The pre-selected slight angle referring to the alignment of the front and rear sights of a two-piece sight is well known and is chosen according to the skill attributed to the skilled artisan. The distances at which a bullet traverses the sight line can be adjusted by adjusting the position of the front and rear sights relative to each other, which is well known to the skilled artisan.

In a conventional two-piece sight, the post or bead of the front sight aligned within the notch or aperture of the rear sight inherently obstructs the user's field of view along the sight line toward a target. This obstruction of the shooters field of view along the sight line by the post or bead of the front sight is distracting, and inherently interferes with the shooter's ability to focus his eye on the intended target aligned along the sight line. Given these and other deficiencies in two-piece sights, the need for continued improvement in two-piece sights is evident.

SUMMARY OF THE INVENTION

According to the principle of the invention, a weapon includes a front sight and a rear sight. The front sight and the rear sight are separate from one another. The front sight includes a front channel. The rear sight includes a rear channel. The front channel and the rear channel are aligned along a sight line. The front channel and the rear channel provide an unobstructed field of view toward a target along the sight line. The front channel and the rear channel are equal in cross-sectional size and shape. The front channel and the rear channel are each generally U-shaped in an illustrative embodiment. The weapon is a firearm. In a particular embodiment, the firearm is a handgun.

According to the principle of the invention, a firearm includes a pistol slide having a front sight and a rear sight. The front sight and the rear sight are separate from one another. The front sight includes a front channel. The rear sight includes a rear channel. The front channel and the rear channel are aligned along a sight line. The front channel and the rear channel provide an unobstructed field of view toward a target along the sight line. The front channel and the rear channel are equal in cross-sectional size and shape. The front channel and the rear channel are each generally U-shaped in an illustrative embodiment.

According to the principle of the invention, a pistol slide includes a front sight and a rear sight. The front sight and the rear sight are separate from one another. The front sight includes a front channel. The rear sight includes a rear channel. The front channel and the rear channel are aligned along a sight line. The front channel and the rear channel provide an unobstructed field of view toward a target along the sight line. The front channel and the rear channel are equal in cross-sectional size and shape. The front channel and the rear channel are each generally U-shaped in an illustrative embodiment.

BRIEF DESCRIPTION OF THE DRAWINGS

Referring to the drawings.

DETAILED DESCRIPTION

Figure 1:
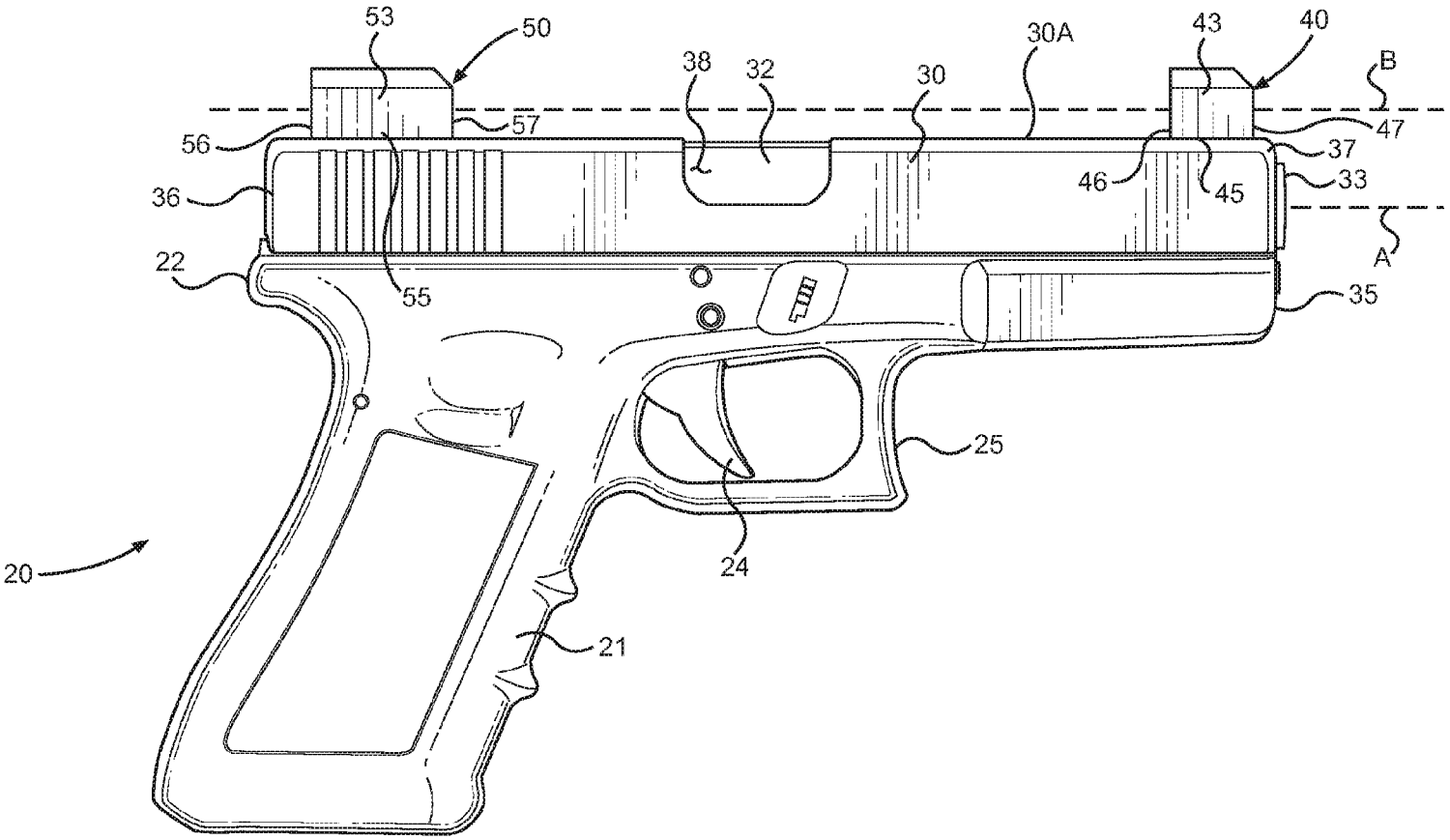
FIG. 1 is a right side elevation view of a firearm including a front sight and a rear sight for guiding the eye in aiming the firearm, the opposite left side elevation view of the firearm being substantially the same thereof.
Figure 2:
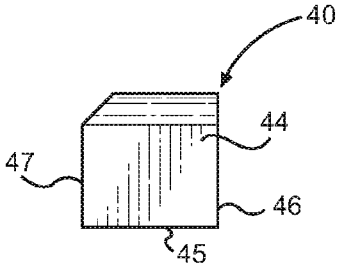
FIG. 2 is a left side elevation view of the front site of FIG. 1, the opposite right side elevation view being the same thereof.
Figure 6:
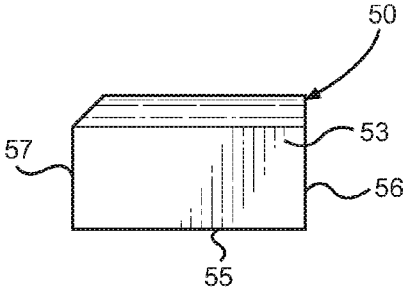
FIG. 6 is a left side elevation view of the rear site of FIG. 1, the opposite right side elevation view being the same thereof.
Figure 3:
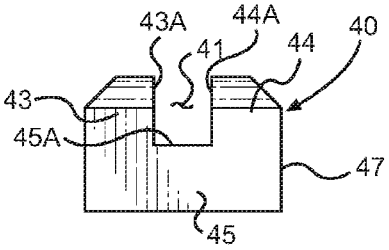
FIG. 3 is a front elevation view of the embodiment of FIG. 2.
Figure 7:
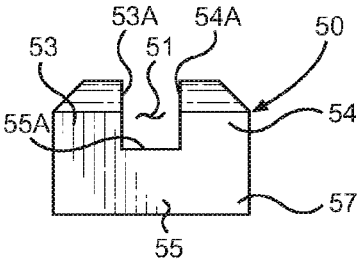
FIG. 7 is a front elevation view of the embodiment of FIG. 6.
Figure 4:
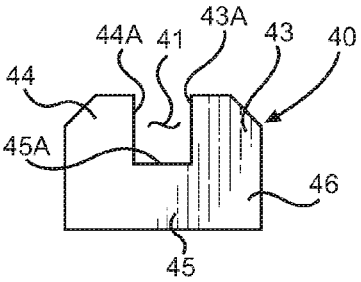
FIG. 4 is a rear elevation view of the embodiment of FIG. 2.
Figure 8:
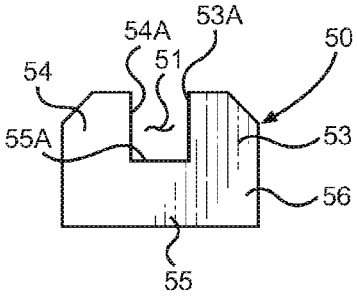
FIG. 8 is a rear elevation view of the embodiment of FIG. 6.
Figure 5:
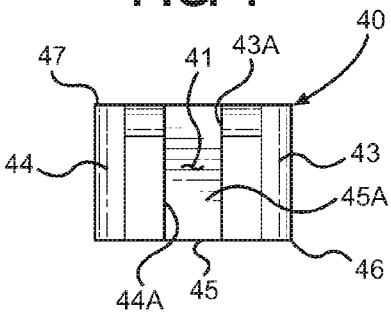
FIG. 5 is a top plan view of the embodiment of FIG. 2.
Figure 9:
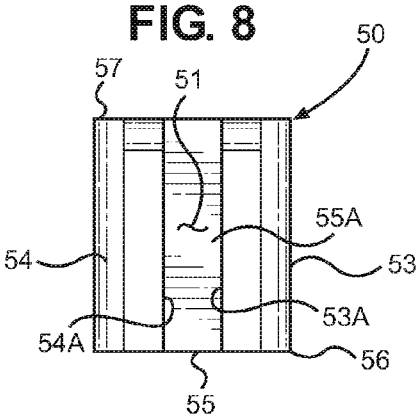
FIG. 9 is a top plan view of the embodiment of FIG. 6.

Turning now to the drawings, in which like reference characters indicate corresponding elements throughout the several views, attention is first directed to FIG. 1 in which there is seen a right side elevation view of a firearm 20, the opposite right side elevation view being substantially the same thereof. Firearm 20 is a weapon from which a shot is discharged by gunpowder.

Figure 10:
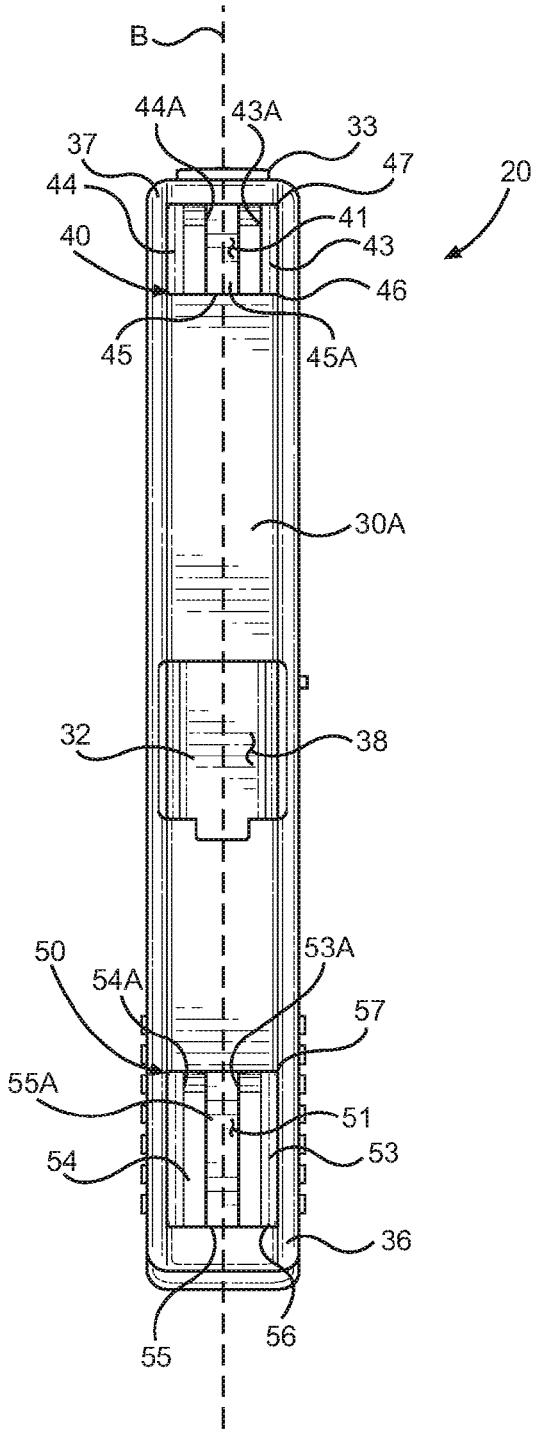
FIG. 10 is a top plan view of the embodiment of FIG. 1.
Figure 12:
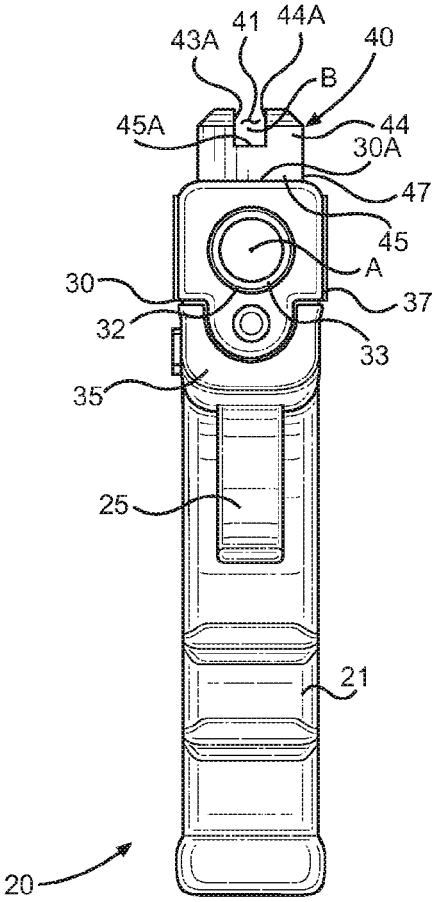
FIG. 12 is a front elevation view of the embodiment of FIG. 1.

Firearm 20 is a handgun in example, namely, a firearm that can be held and fired with one hand. Firearm 20 includes grip 21 proximate to a rear or rearward end 22 of firearm 20, trigger 24 for discharging firearm 20, trigger guard 25, a loop surrounding trigger 24 protecting it from accidental discharge, pistol slide 30, and barrel 32, having muzzle 33 at a front or forward end of firearm 20, within pistol slide 30. In FIGS. 1, 10, and 12, barrel 32 is arranged about central longitudinal axis A along which a bullet fired from firearm 20 travels. In FIG. 1, pistol slide 30 is elongate and has the customary breach end 36 at rear end 22 of firearm 20, muzzle end 37 at front end 35 of firearm 20, and casing ejection port 38 between breach end 36 and muzzle end 37. Pistol slide 30 moves during the firing operating cycle of firearm 20. Pistol slide 30 houses the firing pin or striker and the extractor, serves as the bolt, and is spring-loaded. After the pistol slide moves to its rearmost position in a firing cycle and the bullet casing of the previously fired bullet is ejected through the casing ejection port 38, the spring tension acts on pistol slide 30 thrusting it forward to the starting position while a fresh cartridge from the bullet magazine housed in grip 21 is concurrently chambered. Pistol slide 30 is forced back with each shot fired via recoil or blowback. The described action of pistol slide 30 serves the purposes ejecting the spent casing, cocking the hammer or striker for the next shot, and loading another cartridge into the chamber when pistol slide 30 is thrust forward. If the magazine is empty, pistol slide 30 will lock back, and is released when the slide stop associated with the pistol slide 30 is depressed. If a replacement magazine is inserted before the slide stop is depressed, a new cartridge from the replacement magazine will be chambered. Firearm 20 is generally representative of a typical and well known semiautomatic pistol, further details of which are well known to the skilled artisan and are not discussed in further detail.

According to the principle of the invention, firearm 20 includes a front sight 40 and a rear sight 50 for guiding the eye along sight line or axis B for aiming firearm 20 toward a selected target downrange. In FIGS. 3-5, 10, and 12, front sight 40 includes a front channel 41. In FIGS. 7-9, 10, and 11, rear sight 50 includes a rear channel 51. In FIG. 10, front channel 41 and rear channel 51 are aligned along sight axis or line B. Front channel 41 and rear channel 51 are axially aligned along sight axis or line B so as to provide an unobstructed field of view toward a target along sight line B without either front sight 40 or rear sight 50 providing or otherwise defining an obstruction in front channel 41 and front channel 51 along sight line B that could otherwise obstruct a shooter's field of view along sight line B. Centering front channel 41 with rear channel 51 by eye from behind firearm 20 enables the shooter to accurately view without obstruction and target a selected target downrange along sight line B. Because front channel 41 is centered relative to rear channel 51 by eye during aiming, the aligned front and rear channels 41 and 51 provide a clear line of sight, without obstruction in front and rear channels 41 and 51, for the shooter along sight line B to the downrange target, without there being a post or bead aligned within rear notch 51 that would otherwise inherently obstruct the shooter's field of view along sight line B toward the intended downrange target from rear sight 50 to front sight 40. The completely unobstructed field of view along sight line B provided by front and rear channels 41 and 51 when front channel 41 is centered relative to rear channel 51 by eye along sight line B enables a shooter to have a clear view of the intended downrange target without a post, pin, bead or other sight element in the shooter's field of view along sight line B that could otherwise inherently distract the shooter or inherently interfere with the shooter's ability to focus his eye on the intended target along sight line B.

Figure 11:
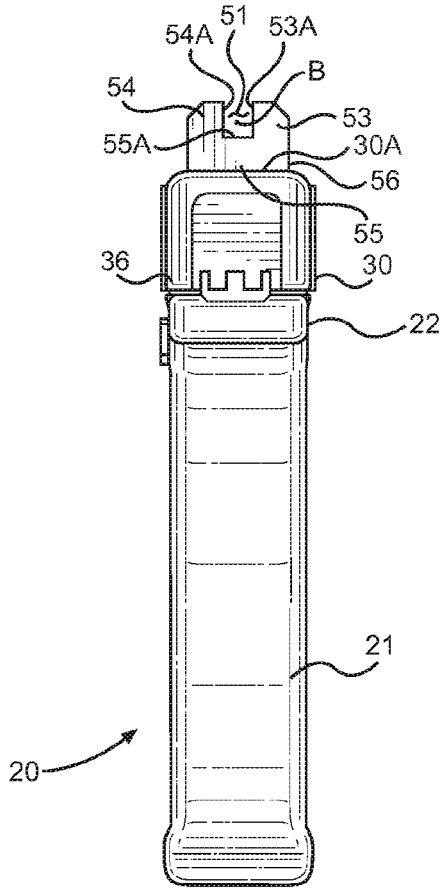
FIG. 11 is a rear elevation view of the embodiment of FIG. 1.

In FIGS. 1, 11, and 12, central longitudinal axis A of barrel 32 correlates with sight line B located above top or upper surface 30A of pistol slide 30. Central longitudinal axis A correlates with sight line B in that sight line B is located above, and is substantially parallel with respect to, central longitudinal axis A of barrel 32. In FIGS. 1 and 10, front and rear sights 40 and 41 are separate from one another, form a two-piece site device, are located on either side of the center of firearm 20 barrel 32, and are aligned parallel to central longitudinal axis A of firearm 20 barrel 32 in FIG. 1, whereby a bullet fired from firearm 20 will strike the selected target below the point of aim along sight line B. A bullet fired from a firearm, including firearm 20, will inherently drop during flight, producing a curved trajectory. Accordingly, front and rear channels 41 and 51 are aligned at a slight angle to central longitudinal axis A of barrel 32, whereby sight line B of aligned front and rear channels 41 and 51 results in a slight upward angle of central longitudinal axis A of barrel 32 relative to sight line B enabling a bullet fired from firearm 20 to pass through sight line A first when the bullet rises and then as it is falling. This is how central longitudinal axis B correlates with sight line B. The distances at which a bullet traverses the sight line can be adjusted by adjusting the position of front and rear channels 41 and 51 relative to each other. The term "substantially parallel" characterizing the alignment of front and rear channels 41 and 51 and sight line B relative to central longitudinal axis B of firearm 20 barrel 32 is a term of art that means that front and rear channels 41 and 51 and sight line B are aligned at a pre-selected slight upward angle relative to central longitudinal axis B of firearm 20 barrel 32 according to the skill attributed to the skilled artisan. The term "slight upward angle" is also a term of art well known to the skilled artisan in the field of two-piece weapon sights.

Front and rear sights 40 and 50 are bodies each fashioned of steel, aluminum, titanium, plastic, or other material or combination of materials having inherently strong, rugged, and impact resistant material characteristics. Front and rear sights 40 and 50 are each formed integrally, such as by molding or machining, and can be fashioned of a plurality of joined parts in an alternate embodiment.

Referring in relevant part to FIGS. 2-5, front sight 40 includes opposed, axially spaced, parallel sidewalls 43 and 44 that extend upright from either side of horizontal base 45 to parallel upper extremities. Sidewalls 43 and 44 and base 45 extend from a rear end 46 of front sight 40 to a front end 47 of front sight 40. Sidewall 43 includes inner surface 43A, sidewall includes inner surface 44A, and base 45 includes inner surface 45A. Inner surface 43A, inner surface 44A, and inner surface 45A concurrently extend from rear end 46 of front sight 40 to front end 47 of front sight 40, and cooperate to define channel 41 of front sight 40 that extends from rear end 46 of front sight 40 to front end 47 of front sight 40. Inner surfaces 43A and 44A are parallel relative to each other and are axially spaced apart, and extend vertically upright from inner surface 45A of base 45. Inner surface 45A of base 45 is horizontal and extends from inner surface 43A to inner surface 44A. Inner surfaces 43A and 44A are perpendicular relative to inner surface 45A of base 45. Channel 41 is generally U-shaped in cross section because inner surface 45A of base 45 is flat rather than curved.

Rear sight 50 includes opposed, axially spaced, parallel sidewalls 53 and 54 that extend upright from either side of horizontal base 55 to parallel upper extremities. Sidewalls 53 and 54 and base 55 extend from a rear end 56 of rear sight 40 to a front end 47 of rear sight 40. Sidewall 53 includes inner surface 53A, sidewall includes inner surface 54A, and base 55 includes inner surface 55A. Inner surface 53A, inner surface 54A, and inner surface 55A concurrently extend from rear end 56 of rear sight 50 to front end 57 of rear sight 50. Inner surfaces 53A and 54A are parallel relative to each other and are axially spaced apart, and extend vertically upright from inner surface 55A of base 55. Inner surface 55A of base 55 is horizontal and extends from inner surface 53A to inner surface 54A. Inner surfaces 53A and 54A are perpendicular relative to inner surface 55A of base 55. Identically to channel 41 of front sight 40, channel 51 is generally U-shaped in cross section because inner surface 55A of base 55 is flat rather than curved. Front channel 41 and rear channel 51 are equal in cross-sectional size and shape. In other words, front channel 41 and rear channel 51 are identical in cross-sectional size and shape.

In FIGS. 1 and 10, front sight 40 is mounted to outer surface 30A of pistol slide 30 proximate to muzzle end 37 of pistol slide 30 and front end 35 of firearm 20. Rear sight 50 is mounted to outer surface 30A of pistol slide 30 proximate to breach end 36 of pistol slide 30 and rear end 22 of firearm 20.

Base 45 of front sight 40 is mounted to outer surface 30A of pistol slide 30, and extends upright to sidewalls 43 and 44 which, in turn, extend upright from base 45 to the respective parallel upper extremities. Front sight 40 is centered on pistol slide 30 and extends longitudinally along pistol slide 30 along sight line B from rear end 46 directed rearwardly to front end 47 directed forwardly. Front channel 41 is centered relative to pistol slide 30 and barrel 32 and extends longitudinally from rear end 46 directed rearwardly to front end 47 directed forwardly. Front sight 40 is rigidly affixed to upper surface 30A of pistol slide 30, such as by welding, with one or more screws or other selected fastener. Front sight 40 can be formed integrally with pistol slide 30 in a particular embodiment.

Base 55 of rear sight 50 is mounted to outer surface 30A of pistol slide 30, and extends upright to sidewalls 53 and 54 which, in turn, extend upright from base 55 to the respective parallel upper extremities. Rear sight 50 is centered on pistol slide 30 and extends longitudinally along pistol slide 30 along sight line B from rear end 56 directed rearwardly to front end 57 directed forwardly. Rear channel 51 is centered relative to pistol slide 30 and barrel 32 and extends longitudinally from rear end 56 directed rearwardly to front end 57 directed forwardly. Rear sight 50 is rigidly affixed to upper surface 30A of pistol slide 30, such as by welding, with one or more screws or other selected fastener. Rear sight 50 can be formed integrally with pistol slide 30 in a particular embodiment.

Front channel 41 and rear channel 51 are aligned along sight axis or line B. Front channel 41 and rear channel 51 are axially aligned along sight axis or line B so as to provide an unobstructed field of view toward a target along sight line B. In FIGS. 1 and 12, central longitudinal axis A of barrel 32 correlates with sight line B located above top or upper surface 30A of pistol slide 30. Again, central longitudinal axis A correlates with sight line B in that sight line B is located above, and is substantially parallel with respect to, central longitudinal axis A of barrel 32, whereby bullet fired from firearm 20 will strike the selected target below the point of aim along sight line B. Because a bullet fired from a firearm, including firearm 20, will inherently drop during fight, producing a curved trajectory, front and rear channels 41 and 51 are aligned at a pre-selected slight angle to central longitudinal axis A of barrel 32, whereby sight line B of aligned front and rear channels 41 and 51 results in a slight upward angle of central longitudinal axis A of barrel 32 relative to sight line B enabling a bulleted fired from firearm 20 to pass through sight line A first when the bullet rises and then as it is falling. This is how central longitudinal axis B correlates with sight line B and the alignment of front and rear channels 41 and 51. The distances at which a bullet traverses sight line B can, of course, be adjusted by adjusting the position of front and rear channels 41 and 51 relative to each other by adjusting the position of the front and rear sights 40 and 50 relative to each other. The pre-selected slight angle referring to the alignment of the front and rear sights 40 and 50 is well known and is chosen according to the skill attributed to the skilled artisan.

According to the principle of the invention, centering front channel 41 relative to rear channel 51 by eye enables the shooter to accurately aim firearm 20 to a downrange target along sight line B from rear sight 50 to front sight 40. Because front channel 41 is centered relative to rear channel 51 by eye during aiming in FIG. 11, the aligned front and rear channels 41 and 51 provide a clear line of sight for the shooter along sight line B to the downrange target, without there being a post or bead aligned within rear notch 51 that would otherwise inherently obstruct the shooter's field of view along sight line B toward the intended downrange target. In FIG. 11, a rear elevation view of firearm 20 from the perspective of a shooter, front channel 41 in FIG. 12 is aligned with rear channel 51 in FIG. 11, a front elevation view of firearm 20, along sight line B. The completely unobstructed field of view along sight line B in FIGS. 11 and 12 from rear sight 50 to front sight 40 provided by front and rear channels 41 and 51 when front channel 41 is centered relative to rear channel 51 by eye along sight line B from rear sight 50 to front sight 40 enables a shooter to have a clear view of the intended downrange target from his perspective behind firearm 20 in FIG. 11 without a post, pin, bead or other sight element of front sight 40 in the shooter's field of view along sight line B that could otherwise inherently distract the shooter or inherently interfere with the shooter's ability to focus his eye on the intended target along sight line B.

In sum, a weapon includes front sight 40 and rear sight 50. Front sight 40 and rear sight 50 are separate from one another and are separate pieces. Front sight 40 includes front channel 41. Rear sight 50 includes rear channel 50. Front channel 41 and rear channel 51 are aligned along sight line B. Front channel 41 and rear channel 51 provide an unobstructed field of view toward a target along sight line B. Front channel 41 and rear channel 51 are equal in cross-sectional size and shape, and are each generally U-shaped in an illustrative embodiment. The weapon is firearm 20. In a particular embodiment, firearm 20 is a handgun in an illustrative embodiment.

According to another aspect, firearm 20 includes pistol slide 30 having front sight 40 and rear sight 50. Front sight 40 and rear sight 50 are separate from one another and are separate pieces. Front sight 40 includes front channel 41. Rear sight 50 includes rear channel 51. Front channel 41 and rear channel 51 are aligned along sight line B. Front channel 41 and rear channel 51 provide an unobstructed field of view toward a target along sight line B. Front channel 41 and rear channel 51 are equal in cross-sectional size and shape. The front channel and the rear channel are each generally U-shaped in an illustrative embodiment. Firearm 20 is a handgun in an illustrative embodiment.

According to yet another aspect, pistol slide 30 includes front sight 40 and rear sight 50. Front sight 40 and rear sight 50 are separate from one another and are separate pieces. Front sight 40 includes front channel 41. Rear sight 50 includes rear channel 51. Front channel 41 and rear channel 51 are aligned along sight line B. Front channel 41 and rear channel 51 provide an unobstructed field of view toward a target along sight line B. Front channel 41 and rear channel 51 are equal in cross-sectional size and shape. Front channel 41 and rear channel 51 are each generally U-shaped in an illustrative embodiment. Firearm 20 is a handgun in an illustrative embodiment.

The invention has been described above with reference to illustrative embodiments. However, those skilled in the art will recognize that changes and modifications may be made to the embodiments without departing from the nature and scope of the invention. For instance, although front and rear channels 41 and 51 are correspondingly generally U-shaped as disclosed herein, they can be formed in other corresponding shapes, such as corresponding V-shapes in a particular example or other selected corresponding shapes. Furthermore, although front and rear sights 40 and 50 are incorporated with firearm 20 in the form of a handgun in the illustrative embodiment, front and rear sights 40 and 50 can be similarly incorporated with other forms of handguns, weapons, and firearms designed to be aimed and fired.

Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. An apparatus, comprising:

a weapon, the weapon includes a front sight and a rear sight, the front sight being located more proximate a muzzle end of the weapon than the rear sight;

the front sight includes a front channel having two opposing and parallel front channel sidewalls;

the rear sight includes a rear channel;

the front channel and the rear channel being aligned along a sight line; and the front channel and the rear channel providing an unobstructed field of view toward a target along the sight line.

2. The apparatus according to claim 1, wherein the front channel and the rear channel are equal in cross-sectional size and shape.

3. The apparatus according to claim 2, wherein the front channel and the rear channel are each generally U-shaped.

4. The apparatus according to claim 1, wherein the weapon is a firearm.

5. An apparatus, comprising:

a firearm, the firearm includes a pistol slide;

the pistol slide includes a front sight and a rear sight, the front sight being located more proximate a muzzle end of the firearm than the rear sight;

the front sight includes a front channel that is defined, at least in part, by two opposing and parallel front channel sidewalls;

the rear sight includes a rear channel;

the front channel and the rear channel being aligned along a sight line; and the front channel and the rear channel providing an unobstructed field of view toward a target along the sight line.

6. The apparatus according to claim 5, wherein the front channel and the rear channel are equal in cross-sectional size and shape.

7. The apparatus according to claim 6, wherein the front channel and the rear channel are each generally U-shaped.

8. An apparatus, comprising:

a pistol slide, the pistol slide includes a front sight and a rear sight, the front sight being located more proximate a muzzle end of the pistol slide than the rear sight;

the front sight includes a front channel having two opposing and parallel front channel sidewalls;

the rear sight includes a rear channel;

the front channel and the rear channel being aligned along a sight line; and the front channel and the rear channel providing an unobstructed field of view toward a target along the sight line.

9. The apparatus according to claim 8, wherein the front channel and the rear channel are equal in cross-sectional size and shape.

10. The apparatus according to claim 9, wherein the front channel and the rear channel are each generally U-shaped.

11. The apparatus of claim 1, wherein the rear channel includes two opposing and parallel rear channel sidewalls.

12. The apparatus of claim 5, wherein the rear channel includes two opposing and parallel rear channel sidewalls.

13. The apparatus of claim 8, wherein the rear channel includes two opposing and parallel rear channel sidewalls.

* * * * *